US008628821B2

(12) United States Patent
Wang et al.

(10) Patent No.: US 8,628,821 B2
(45) **Date of Patent: *Jan. 14, 2014**

(54) FORMATION OF THIN UNIFORM COATINGS ON BLADE EDGES USING ISOSTATIC PRESS

(75) Inventors: Xiandong Wang, Acton, MA (US); Neville Sonnenberg, Newton, MA (US)

(73) Assignee: The Gillette Company, Boston, MA (US)

( * ) Notice: Subject to any disclaimer, the term of this patent is extended or adjusted under 35 U.S.C. 154(b) by 763 days.

This patent is subject to a terminal disclaimer.

(21) Appl. No.: 12/352,371

(22) Filed: Jan. 12, 2009

(65) Prior Publication Data

US 2010/0178493 A1 Jul. 15, 2010

(51) Int. Cl.
*B05D 1/00* (2006.01)

(52) U.S. Cl.
USPC ..... 427/209; 427/388.1; 428/421; 30/346.53

(58) Field of Classification Search
USPC ..... 264/419, 313, 314, 316, 271.1; 76/104.1–106.5; 30/346–357; 427/209, 427/435, 427.5, 388.1; 428/421
See application file for complete search history.

(56) References Cited

U.S. PATENT DOCUMENTS

| | | | | |
|---|---|---|---|---|
| 3,459,213 | A * | 8/1969 | Schenck, Jr. et al. | 137/340 |
| 3,537,700 | A * | 11/1970 | Schenck, Jr. et al. | 264/112 |
| 4,368,217 | A * | 1/1983 | Tournut | 427/181 |
| 5,096,518 | A * | 3/1992 | Fujikawa et al. | 156/89.28 |
| 5,477,756 | A * | 12/1995 | Trankiem et al. | 76/104.1 |
| 5,985,459 | A * | 11/1999 | Kwiecien et al. | 428/421 |
| 6,311,364 | B1 * | 11/2001 | Reo | 15/250.48 |
| 7,043,819 | B1 * | 5/2006 | Arnold | 29/527.2 |
| 2005/0268470 | A1 * | 12/2005 | Skrobis et al. | 30/346.54 |
| 2009/0072428 | A1 * | 3/2009 | Lizotte et al. | 264/101 |

FOREIGN PATENT DOCUMENTS

DE 20312001 U1 10/2003

OTHER PUBLICATIONS

Isostatic Pressing. Description.[online]. Metal Powder Industries Federation, [retrieved on Oct. 14, 2011]. Retrieved from the Internet: <URL:http://www.mpif.org/designcenter/isostatic.asp?linkid=108>.*

Gul, R. M. and McGarry, F. J. (2004), Processing of ultra-high molecular weight polyethylene by hot isostatic pressing, and the effect of processing parameters on its microstructure. Polym Eng Sci, 44: 1848-1857. doi: 10.1002/pen.20186.*

* cited by examiner

*Primary Examiner* — Richard Crispino
*Assistant Examiner* — Yana Belyaev
(74) *Attorney, Agent, or Firm* — Joanne N. Pappas; Kevin C. Johnson; Steven W. Miller

(57) ABSTRACT

The invention discloses isostatic-pressing (IP) applied to polymer (e.g., PTFE) coated razor blade edges to produce thin, dense, and uniform blade edges which in turn exhibit low initial cutting forces correlating with a more comfortable shaves. The isostatic press utilized may be a hot isostatic press (HIP) or cold isostatic press (CIP) or any other isostatic press process. The HIP conditions may include an environment of elevated temperatures and pressures in an inert atmosphere. The HIP conditions may be applied to non-sintered coatings or sintered coatings or before or after a Flutec® process is applied to coatings. CIP conditions may include room temperature and elevated pressure. The polymeric material may be a fluoropolymer or a non-fluoropolymer material or any composite thereof. It may be deposited initially by any method, including but not limited to, dipping, spin coating, sputtering, or thermal Chemical Vapor Deposition (CVD).

12 Claims, 8 Drawing Sheets

FORMATION OF THIN UNIFORM COATINGS ON BLADE EDGES USING ISOSTATIC PRESS

FIELD OF THE INVENTION

This invention relates to razor blades, and more particularly to coatings on razor blade cutting edges and manufacture thereof.

BACKGROUND OF THE INVENTION

It is generally known in the prior art that a wet razor assembled with fluoropolymer coated blades outperforms a razor assembled without fluoropolymer-coated blades. One of the most common fluoropolymers utilized for coating razor blades is polytetrafluoroethylene or PTFE (or a form of Teflon®). The addition of PTFE (e.g., telomer) coating to the blade cutting edge dramatically reduces the cutting forces for beard hairs or other types of hair fibers. A reduced cutting force is desirable as it significantly improves shaving attributes including safety, closeness and comfort. Such known PTFE-coated blade edges are described in U.S. Pat. No. 3,071,856.

There are many types of coating processes that could be utilized to produce polymer coated (e.g., PTFE) coated blade edges. Some processes involve aqueous dispersion of the PTFE and some involve organic dispersion of the PTFE. Aqueous dispersion processes may include spraying, spin coating and dipping. PTFE may also be deposited on blade edges using vacuum based processes such as sputtering or thermal Chemical Vapor Deposition (CVD). However, when quality, cost and environmental issues are considered, the spraying of an aqueous PTFE dispersion is typically desired. PTFE dispersion in an organic solvent is also a known process in the art. This type of dispersion may include for example, Dupont's Vydax 100 in isopropanol as described in U.S. Pat. No. 5,477,756.

Regardless of whether an aqueous or organic based dispersion is utilized, if a spraying process is utilized along with a subsequent sintering process, a non-uniform surface morphology, on a microscopic scale, is produced on blade edges and in the area proximal to the ultimate blade tips as shown in FIG. 1. This may be caused by the particle size dispersion of PTFE particles and by the wetting and spreading dynamics of dispersion. Typically, the average thickness of PTFE coating produced by a spraying process is about 0.2 μm to about 0.5 μm.

It should be noted that the thinner the PTFE coating becomes on blade edges, the lower the cutting force (assuming the coating is uniform). While this is generally desirable as mentioned above, too thin PTFE coatings on blade edges can give rise to poor coverage and low wear resistance due to intrinsic properties of the PTFE material. Alternatively, a too thick PTFE coating may produce very high initial cutting forces, which generally may lead to more drag, pull, and tug, eventually losing cutting efficiency and subsequently shaving comfort. Thus, there is a technical challenge to balance the attributes of the polymer material with obtaining the thinnest coating possible to provide improved shaving attributes.

This fuels the desire in the art to form a thin, dense and uniform PTFE coating with extremely low coefficient of friction onto the blade edge.

Previous efforts made towards this objective, such as selection of different PTFE dispersions, modification of the surfactant used in the dispersion and/or optimization of spray-sintering conditions have had moderate effectiveness.

Some known solutions for thinning the PTFE on the blade edges include (1) mechanical abrasion, polishing, wearing, or pushing back; (2) a high energy beam (electron, gamma ray or X-ray, synchrotron) or plasma etching; and (3) application of Flutec® technology or Perfluoper-hydrophenanthrene (PP11) oligomers.

The disadvantage of the first mechanical abrasion solution is that it is difficult to control, may produce non-uniform thinning and may also cause edge damage. The disadvantage of applying high energy beams to thin the PTFE is that it may change the cross linking and molecular weight of PTFE thereby increasing friction and hence, cutting force.

One relatively successful approach has been the application of Flutec® technology as described in U.S. Pat. No. 5,985,459 which is capable of reducing the thickness (e.g., or thinning) a relatively thick PTFE coating produced by a spray and sintering process. This prior art process, as shown in FIG. 1 depicts a flow 10 where blade 12 which has sprayed PTFE particles 11 coated on and around its tip 13 is sintered as shown at step 14 with Argon at about 1 atmospheric pressure (1 atm) and at a temperature of about 330 degrees Celsius (° C.) to about 370° C. to produce a sintered PTFE coating 16. Typically, the average thickness of PTFE coating produced by a spraying process is about 0.2 μm to about 0.5 μm.

The Flutec® technology as shown at step 17 is subsequently placed on coating 16 to produce a thinned PTFE coating 18. This typically includes soaking the PTFE coated blades 16 in solvents under elevated temperatures of about 270° C. to about 370° C. and at a pressure of about 3 atm to about 6 atm. In general, the solvents employed in the Flutec® process include solvents such as perfluoroalkanes, perfluorocycloalkanes, or perfluoropolyethers.

With the Flutec® approach, a more uniform PTFE coating 18 with about 10 nm to about 20 nm in thickness may be achieved consequently resulting in a reduction of the first cutting force of blade edges on wool-felt-fibers of nearly 40% compared to many approaches utilized prior to the knowledge of the Flutec® treatment. However, a major drawback to the Flutec® process is that even though most of the solvents used are capable of being recycled, some needs to be disposed of as waste.

Another disadvantage of the Flutec® technology is that the chemical solvent used in the Flutec® process typically removes most of the PTFE materials from the sintered coating 18 which, as mentioned above, provide the improved shaving attributes.

Another disadvantage of the Flutec® technology is that generally the resultant Flutec® coatings still exhibit porosity since coating molecules are not densely packed. Because of this, a coating with a desirably high molecular weight is difficult to achieve.

Thus, there is a need for an alternative apparatus and method to produce thin, uniform and dense coatings on blade edges.

SUMMARY OF THE INVENTION

This invention provides a method for forming a razor blade including isostatically pressing (IP) at least one blade edge coated with at least one polymeric material.

The polymeric material of the present invention includes a fluoropolymer such as PTFE. The isostatic press may be a hot isostatic press (HIP) or a cold isostatic press (CIP). The resulting isostatically-pressed coating ranges in thickness from about 10 nm to about 100 nm, has a substantially uniform surface morphology, and has substantially zero porosity.

In certain embodiments, the isostatic press conditions include a temperature in the range of about 300° C. to about 380° C., a pressure range of about 10 MPa to about 550 MPa, an inert atmosphere of argon or nitrogen where the isostatic press conditions may be applied for a time ranging from about 10 minutes to about 10 hours.

The isostatic press conditions may be applied to a polymer coating on the blade edge after the polymer coating has been sintered or undergone Flutec® application.

In one aspect of the present invention, the polymeric material is comprised of a non-fluoropolymer.

In yet another aspect of the invention, the razor blade substrate may include blades which are steel with or without a top layer coating of Chromium (Cr), Diamond-like Carbon (DLC), Amorphous Diamond, or Chromium/Platinum (Cr/Pt).

In still yet another aspect of the invention, the blade edge of the present invention may be initially coated with the polymer material by dipping, spin coating, sputtering, or thermal Chemical Vapor Deposition (CVD).

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

This invention relates to razor blade cutting edges which are formed such that they exhibit an improvement in shaving attributes in the first few shaves. One principal aspect of the invention is directed towards forming a thin, dense and uniform coating on the blade edge which has a low cutting force and low friction. The term "thin" refers to the thickness of the coating of the present invention. Generally, the thinner the coating becomes on blade edges, the lower the cutting force and the better the shaving attributes. The term "dense" as used herein signifies the lack or substantial elimination of porosity exhibited in the coating of the present invention. Denseness is desirable as it provides for lower friction and cutting forces, more consistent shaves, in addition lower wear rates (e.g., longer blade life). The term "uniform" as used herein refers to the surface morphology (e.g., smoothness) exhibited in the coating of the present invention. Similarly, the more uniform the surface of the coating is the more comfortable the shave will be and the lower the wear rate, among other things. As mentioned above, a commonly utilized material for blade edge coating is a type of fluoropolymer, namely PTFE. As such, PTFE will be referenced throughout the description of the instant invention but not to the exclusion of other materials (mentioned below) which may be substituted substantially equivalently.

Razor blade edges produced according to the present invention, as will be described below, exhibit lower initial cutting forces which correlate with more comfortable first few shaves, than those produced by conventional spraying and sintering technologies.

The invention discloses a novel application of a known process or technology called isostatic pressing which may include hot isostatic pressing (HIP), cold isostatic pressing (CIP), other related CIP processes or other isostatic processes. Generally, isostatic presses are known to be used for compressing materials such as ceramics, metal alloys and other inorganic materials. Some examples of the uses of HIP process include ceramic turbine blades, nickel based superalloy turbines, aluminum casting and materials that need low porosity. While isostatic pressing processes represent a relatively mature technology, they have generally not been utilized in the polymer industry.

Figure 2:
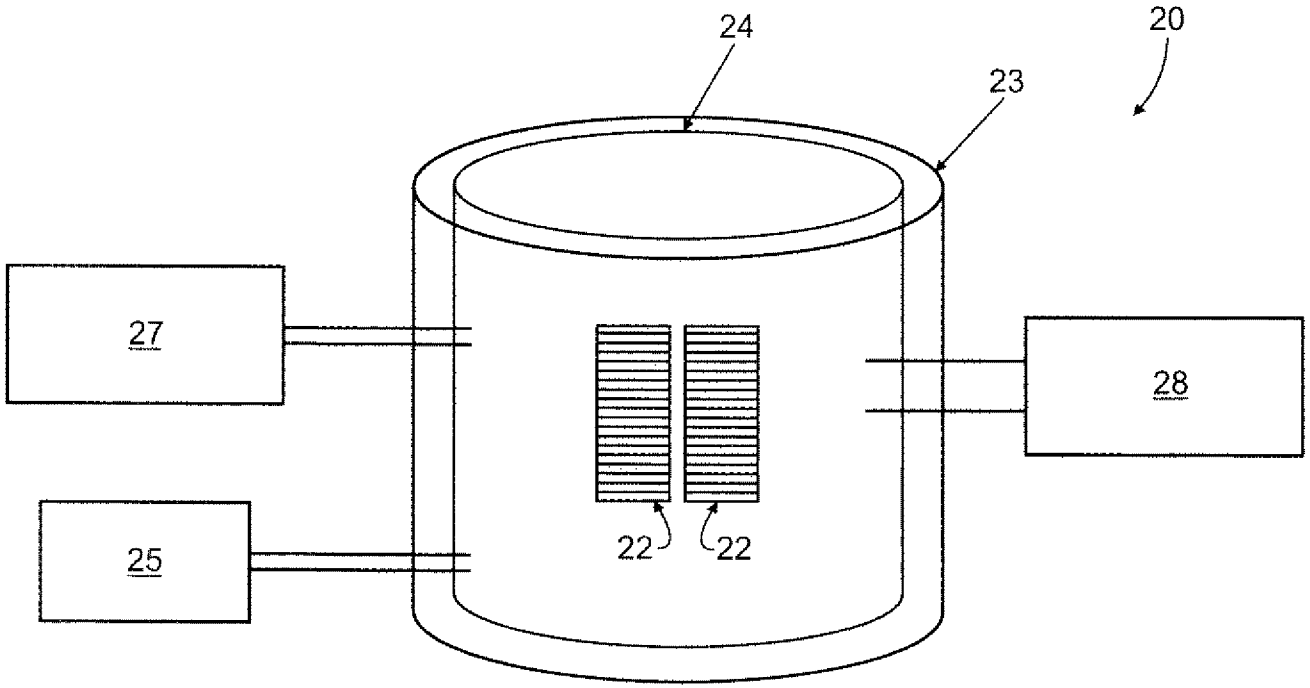
FIG. 2 is a schematic of an isostatic press in accordance with the present invention.

As shown in FIG. 2, the HIP process apparatus 20 typically subjects components to both elevated temperature in a heating chamber 23 and elevated isostatic gas pressure in a high pressure containment vessel 24. In the instant invention, the components placed in the apparatus 20 are razor blades, inserted for instance in the form of blade spindles 22. A vacuum 25 pumps air into the vessel 24. A pressurizing gas most commonly used in a HIP process via compressor 27 is Argon (Ar) which is an inert gas. Other gasses may be used such as nitrogen. Such an inert gas is used to reduce damage to the blades and the polymer material. The HIP chamber 20 is heated, causing the pressure inside the pressure vessel 24 to increase and the gas, pressure and temperature are managed by a control unit 28. Generally, isostatic processes such as HIP may be applied for a time ranging from about 10 minutes to about 10 hours, desirably about 20 to 30 minutes.

In all types of isostatic processes, pressure is applied to the component from all directions; hence the term "isostatic."

Though not shown in FIG. 2, the CIP process is fairly similar to the HIP process except that it functions at room temperature and may involve a liquid medium (often an oil-water mixture) as a pressure mechanism, pumped in and pressurized on all sides to produce a uniform product and may in many instances require additional processing (e.g., such as sintering) to provide an adequate finished product. Generally, CIP involves applying high isostatic pressure over about 98 MPa (1000 kgf/cm$^2$) to about 550 MPa. CIP is a very effective powder-compacting process. Two well-known CIP methods include the wet-bag process in which the powder substance enclosed in a rubber bag is directly submerged into the high-pressure medium, and the dry-bag process in which the pressing work is accomplished through rubber molds built into the pressure vessel.

For purposes of the present invention, it is contemplated that any of the known isostatic pressing processes may be used substantially interchangeably to generate the desired product results with plausibly some modifications either in temperature, pressure or added processing. Hence, while a hot isostatic pressing embodiment of the present invention is described in more detail below, the notion to use any of the other types of isostatic pressing (either in addition to or in its place) is contemplated in the present invention.

In a desirable embodiment of the present invention, hot-isostatic-pressing is used on blade edges or polymer coated (e.g. PTFE-coated) blade edges to produce thin, dense, and uniform blade edges. One major advantage of utilizing an isostatic pressing process such as the HIP process over the prior art Flutec® process is that the isostatic processes (e.g. HIP) typically do not involve the use of any organic solvents, thereby providing an environmentally benign and simple solution.

The hot isostatic press (HIP) when applied to PTFE coating on blade edges in the present invention forces the PTFE coating on the blade edges to sinter and creep (similar to melting) as will be described below. Sintering will heat and form a coherent mass of the PTFE particles. Creeping will gradually and permanently deform the PTFE particle coating upon continued application of heat or pressure. Thus, by causing the material to sinter and creep (similar to melting), the HIP process is capable of forming a dense, thin uniform PTFE coating on the blade edge.

In one aspect, the novel application of the hot-isostatic-pressing (HIP) process in the present invention for the treatment of PTFE coated blade edges (e.g., traditionally spray or spray-sintered) may produce extremely thin, dense and uniform PTFE coatings. As mentioned above, it has been known that both PTFE coating thickness and its morphology on the blade edge are very critical and important in terms of lowering the cutting force and obtaining a better shaving experience.

Thus, the HIP process applied to blade edges provides a new application for HIP conditions that may effectively manipulate the thickness of a polymer coating as described below. In one embodiment of the present invention of FIG. 3, a hot-isostatic-press is used on coated blade edges to produce thin, dense, and uniformly coated blade edges.

Figure 3:
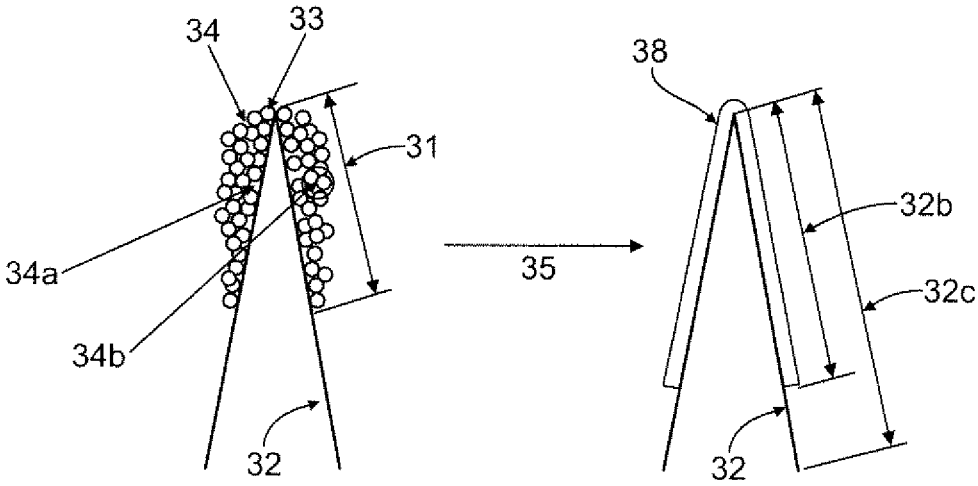
FIG. 3 is a flow diagram in accordance with an embodiment of the present invention using a hot isostatic press process.

Referring now to FIG. 3, at least one blade 32 which includes at least one polymer coating such as PTFE particles 34 (e.g., previously sprayed) on and around blade tip 33 is, at step 35, subjected to HIP conditions as described in conjunction with FIG. 2 to provide a thin uniform PTFE coating 38 on blade 32 in accordance with an embodiment of the present invention.

The HIP conditions at step 35 in the present invention may include a temperature in the range of about 300° C. to about 380° C. or a temperature near the PTFE melting temperature which is about 327° C. A desirable temperature in the present invention may be from about 330° C. to about 370° C. In addition, in the present invention the HIP conditions at step 35 may include a pressure range of about 100 MPa to about 550 MPa. Usually HIP is run at about 100 MPa to about 350 MPa and desirably at about 220 MPa. As mentioned above, the HIP conditions at step 35 in the present invention may necessarily include an inert atmosphere, desirably in argon or nitrogen.

By having a rather high HIP temperature, the PTFE coating is softened as mentioned above, thereby enhancing the deformity or "creep" or flow of the PTFE material (e.g., similar to melting) over the blade edge surface. As the PTFE material flows, it creeps into the apertures 34*a* of FIG. 3 within the surface of the blade edge. The removal of most of the apertures provides for a dense coating with substantially zero porosity. In addition to this creeping mechanistic during the HIP process, the high HIP pressure simultaneously pushes the existing thick PTFE coating in the vicinity of blade tips away from the tip so that a very thin, dense, and uniform coating is formed on the blade tip edge 33 as shown in FIG. 3 at coating 38. The thickness of resulting PTFE coating 38 of FIG. 3 is in the range of about 10 nm to about 100 nm and desirably about 20 nm. The thickness 38*a* of coating 38 is substantially uniform throughout all areas of the coating with the potential for some slightly non-significant or slightly thicker areas (e.g., at the blade tip). The surface morphology of coating 38 is smooth having virtually no agglomerations of PTFE particles (e.g., areas of non-uniformity in thickness or protruding PTFE particles) thereby providing optimal friction and cutting force. In some instances, the surface area 32*b* covered by coating 38 (e.g., after HIP) may be greater than the surface area 31 covered by coating 34. The surface area or length 37 is desirably greater than 150 μm as this is approximately the area of the razor blade that would touch a user's skin. Because HIP conditions are generally provided with the capacity for good quality control, the desired coating dimension of 150 μm is generally easily attainable.

Figure 3A:
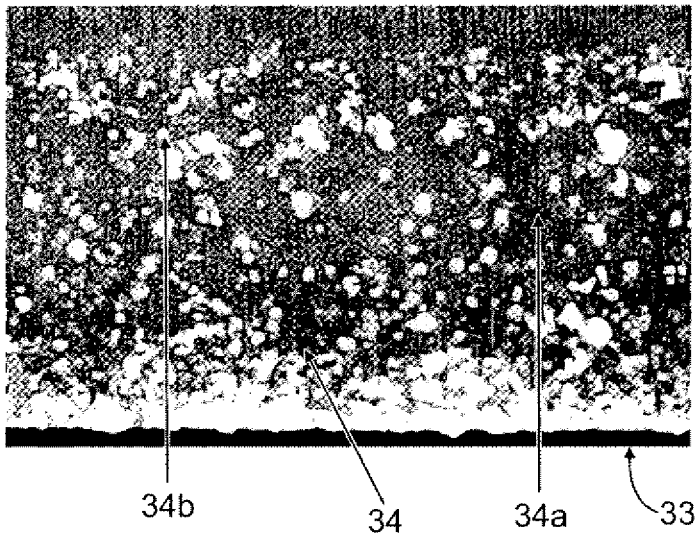
FIG. 3*a* shows an optical microscope photograph of the blade bevel areas of FIG. 3 prior to using a hot isostatic press process.
Figure 3B:
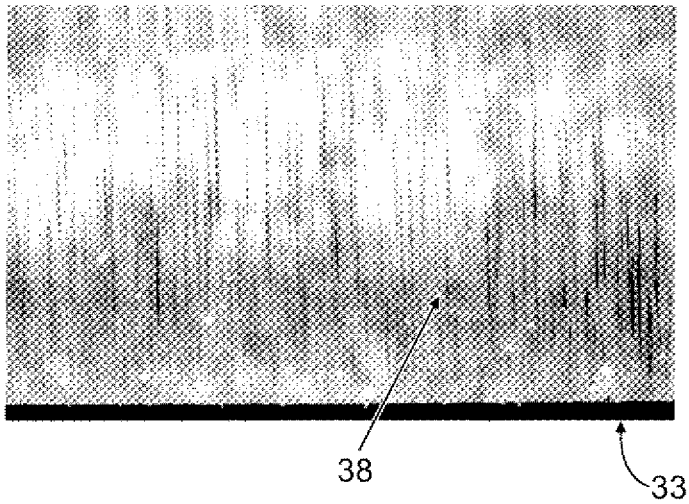
FIG. 3*b* shows an optical microscope photograph of the blade bevel areas of FIG. 3 after using a hot isostatic press process.

The characteristics of the coating 38 of the present invention are much improved over coating 34. One way to recognize this relies on evaluations of the interference color of PTFE coating 38. For instance, as shown in the photographs of FIG. 3*a* and FIG. 3*b*, the use of an optical microscope with polarized light is one way to evaluate the characteristics (e.g., uniformity, surface morphology, denseness etc.) of PTFE coated blade edges. In FIG. 3*a*, a non-sintered PTFE coating (e.g., coating 34 of FIG. 3) is shown taken before the HIP process is applied where 2.50 wt % of Dupont's LW1200 PTFE dispersion was utilized with a molecular weight average of about 45,000 Dalton. FIG. 3*a* corresponds to a photograph of bevel area 32*b* or one side of the blade edge of FIG. 3, the blade edge 32*c* having a total length of about 250 um. Tip 33 is denoted at the bottoms of the photographs in FIGS. 3*a* and 3*b*.

After the HIP process is applied (e.g., at step 35 of FIG. 3) at or about 370° C. and at or about 250 MPa, the resultant coating 38 produced conforms over the surface of the blade edge in that it effectively "hugs" the contours of the surface and creeps the polymer into the apertures 34*a* of FIG. 3 within the surface of the blade edge. It also may smooth out groups of PTFE particle clusters 34*b*. These spots 34*b* indicate areas of non-uniformity in the surface morphology of the coated blade edge in that they may add thickness in those areas; such a thickness is not desirable (e.g., at the tip 33 of the blade) as it may affect the friction and cutting force. Coating 38 is depicted in the photograph of FIG. 3*b*. The naked eye may easily note the differences in the coating surface morphology between the "before HIP" photograph (shown in FIG. 3*a*) and the "after HIP" photograph (shown in FIG. 3*b*). One visible difference includes the substantial elimination in FIG. 3*b*'s photograph of pores 34*a* and PTFE particle agglomerations 34*b*.

In general, coverage of PTFE coating on the blade edge substrate and the surface (or biological) properties of the coating will be improved after HIP processes. In particular, one improved characteristic is the thickness of the PTFE coating around the ultimate tips of the blade edges may be substantially thinned and uniform, a desirable result significantly lowering the cutting force of the blades (e.g., wool-felt fiber or hair fiber cutting force is significantly reduced). For example, the $1^{st}$ wool-felt-cut force (or cutting force) may have a percentage force reduction after HIP processing from about 15% to about 65% or the $1^{st}$ wool-felt-cut force (or cutting force) be reduced in the range of about 1.10 lbs to about 1.70 lbs after HIP processing.

This consequence of the HIP process (e.g., lowering of the first cutting force of the blade edge substantially compared with traditional sintering processes) provides blade edges with lower first cutting force leading to more comfortable and closer shaves. It has been shown that improved shaving attributes such as closeness and comfort have been achieved with HIP-treated PTFE coated blades for a wet shaving system.

Figure 1:
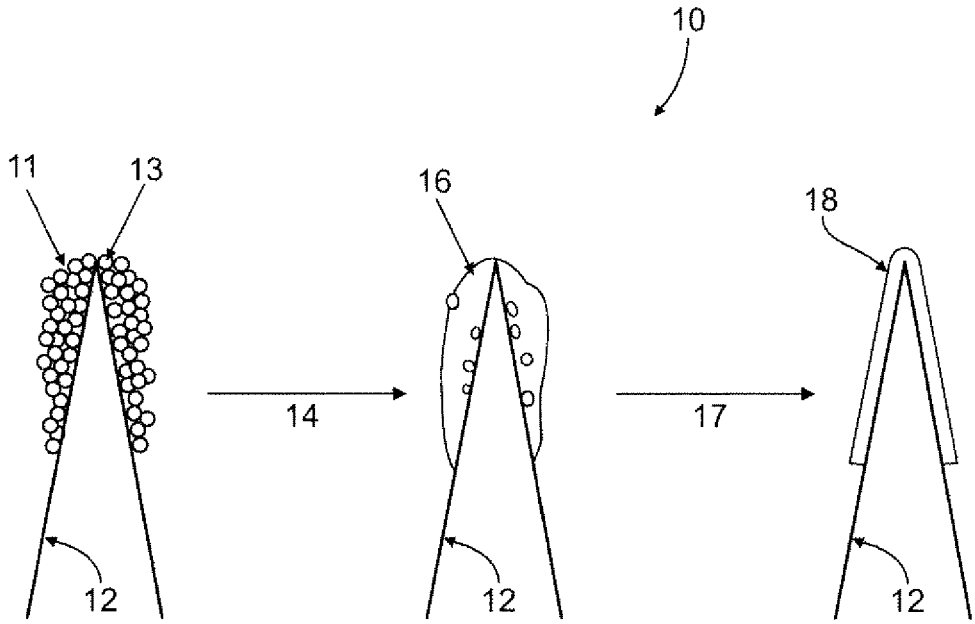
FIG. 1 is a flow diagram depicting a prior art thinning process using Flutec® technology.

Since the novel HIP technology applied to blade edges provides a non-chemical technique for thinning the PTFE coating on blade edges, it is also advantageous over known chemical processes (e.g., Flutec® technology) since there is no loss of PTFE material. It follows that, under optimized conditions, this novel technique as described herein may be an alternative approach to known thinning processes, (e.g., of FIG. 1 depicting spray sintering and Flutec® technology) and as such, may be used in lieu of these processes entirely.

FIGS. 3, 3*a* and 3*b* above describe the HIP process applied directly to treat polymer coated blades that have not undergone any other treatment (e.g., sintering) to thin the coated polymer and achieve low cutting force blade edges, a simplification of the polymer coating process as a whole.

Figure 4:
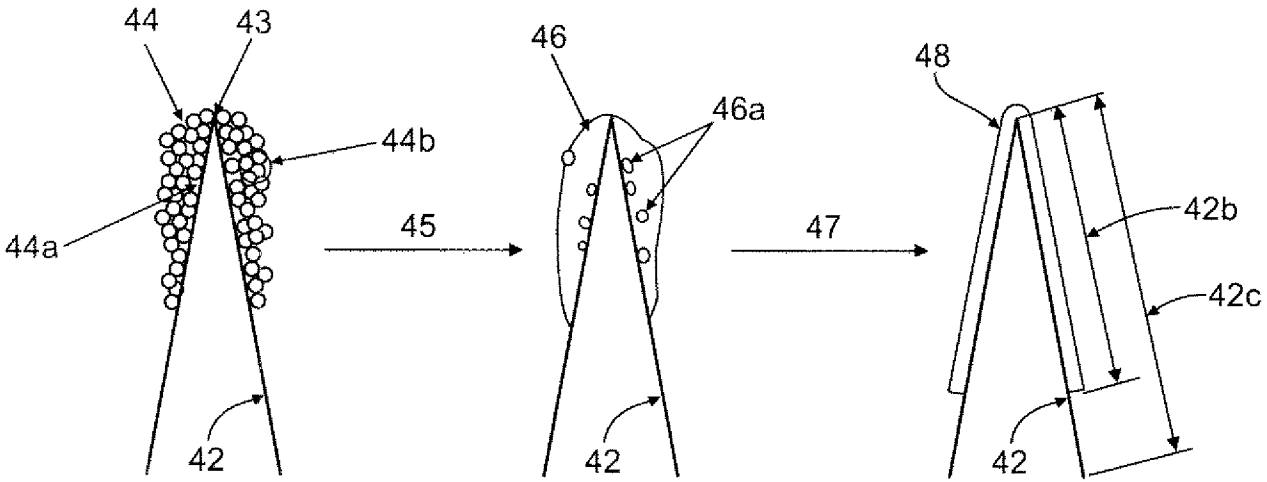
FIG. 4 is a flow diagram in accordance with another embodiment of the present invention using a hot isostatic press process.

Referring now to FIG. 4, in another embodiment of the present invention the HIP process may be applied after PTFE coated blade edges are treated by sintering. As illustrated in FIG. 4, blade 42 which includes a coating with PTFE particles 44 (e.g., sprayed) on and around blade tip 43 is subjected to sintering at step 45. The sintering step includes subjecting blade 42 to at or about 1 atm and from about 330° C. to about 370° C. After the sintering step, there may be a significant reduction in apertures 44*a* found within coating 46. This provides for a coating 46 with some improved density. Groups of PTFE particles 44*b* depict agglomerations and indicate areas of non-uniformity in coating 44 and may also, after sintering, be reduced though may remain in coating 46 as shown in FIG. 4 at spots 46*a*. As shown in FIG. 4, the PTFE particles 46 after sintering are smoother than original PTFE particles 44. The thickness of PTFE particles 46 may be about 0.2 μm to about 1 μm. Subjecting blade 42 with particles 46 to HIP conditions as depicted at step 47 provides a thinner uniform PTFE coating 48 on blade 42 in accordance with another embodiment of the present invention. The thickness of PTFE particles 48 is about 10 nm to about 100 nm, or desirably about 20 nm. The HIP conditions at step 47 in FIG. 4 are similar to the HIP conditions described above in conjunction with FIG. 3.

Again, by having a rather high HIP temperature, the PTFE coating 46 is softened thereby enhancing the deformity or "creep" or flow of the PTFE material over the blade edge surface. As the PTFE material flows, it further creeps into any remaining apertures or pores 44*a* of FIG. 4 within the surface of the blade edge. The removal of the apertures 44*a* provides for a desirable dense coating with substantially zero porosity which provides consistent shaves, lower friction, and improved wear rates. Groups of PTFE particles 44*b* depict agglomerations and indicate areas of non-uniformity and are also substantially smoothed out and reduced further during the HIP step 47. Spots 46*a* in FIG. 4 within coating 46 also depict remaining agglomerations of PTFE particles. These spots 46*a* indicate areas of non-uniformity in the surface morphology of the coated blade edge in that by protruding out they may add thickness in those areas and this generally is not desirable as it may negatively affect the friction and cutting force. These spots 46*a* may be substantially removed in resultant coating 48. Thus, the porosity in resultant coating 48 is substantially non-existent with few, if any, apertures 44*a* and other agglomerations 44*b* with a resultant surface morphology being substantially uniform, smooth and few, if any, PTFE particles 46*a*.

In addition to this creeping mechanistic during the HIP process, the elevated HIP pressure simultaneously pushes the existing thick PTFE coating in the vicinity of blade tips back and away from the tips so that a very thin and uniform PTFE coating 48 is formed on the blade tip edge 43 as shown in FIG. 4. The thickness of resulting PTFE coating 48 of FIG. 4 as mentioned above with respect to FIG. 3 is about 10 nm to about 100 nm, and desirably about 20 nm.

Figure 4A:
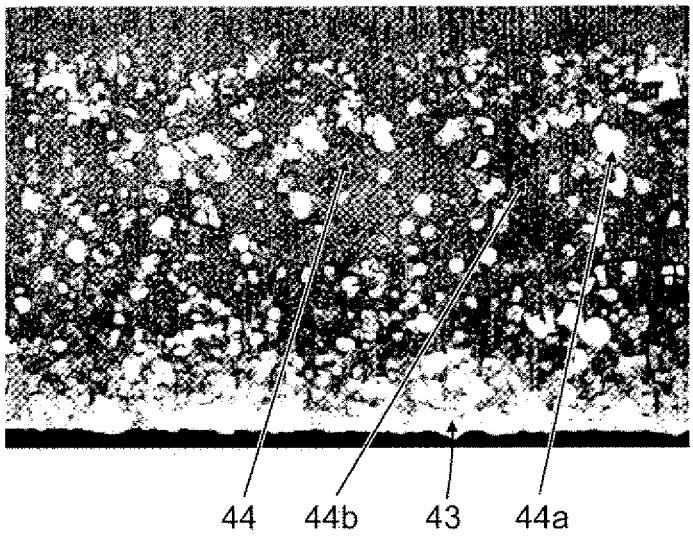
FIG. 4*a* shows optical microscope photographs of the blade bevel areas of FIG. 4 prior to using a hot isostatic press process.
Figure 4B:
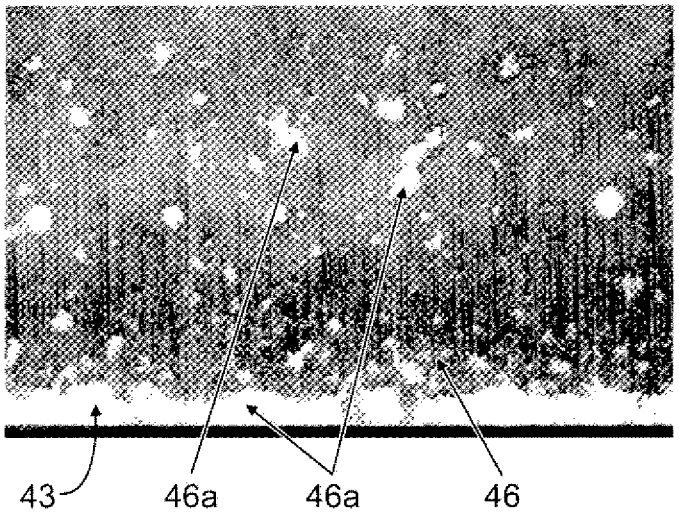
FIG. 4*b* shows optical microscope photographs of the blade bevel areas of FIG. 4*a* after a sintering process.
Figure 4C:
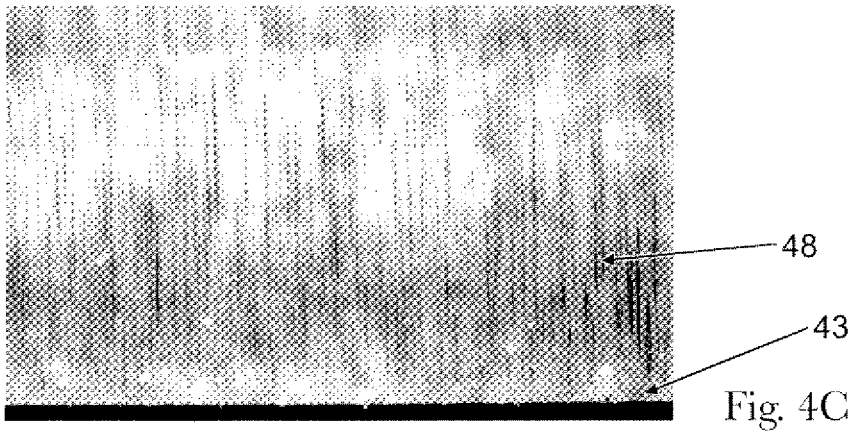
FIG. 4*c* shows optical microscope photographs of the blade bevel areas of FIG. 4*b* after using a hot isostatic press process.

Referring now to FIGS. 4*a*, 4*b*, and 4*c*, the improvements of the coating characteristics over the three stages described in conjunction with FIG. 4 are depicted by optical microscope photographs. These photographs as mentioned above assist in showing the interference color of PTFE coating by using polarized light as a way to evaluate the characteristics (e.g., uniformity, surface morphology, and density) of PTFE coated blade edges. Each photograph in FIGS. 4*a*, 4*b*, and 4*c* respectively corresponds to each bevel area 42*b* of FIG. 4, where the blade edge may have a total length 42*c* of about 250 um. Tip 43 is denoted at being at the bottoms of the photographs in FIGS. 4*a*, 4*b*, and 4*c* respectively. These photographs were taken with a 2.50 wt % PTFE (Dupont Te-3667N dispersion) coated blade edge sample at different stages. The molecular weight average is about 110,000 Dalton. The molecular weight range of the present invention coating ranges from about 3000 to 1 million Dalton, and is desirably in the range of about 40,000 Dalton to about 200,000 Dalton.

In FIG. 4*a*, coating 44 of FIG. 4 is shown applied to blade 42 before the sintering step 45 in optical microscope photograph A. A traditionally sintered PTFE coating (e.g., coating 46 of FIG. 4) is shown in FIG. 4*b* taken at 343° C. in Argon and at 1 atm before the HIP process is applied. After the HIP process is applied (e.g., at step 47 of FIG. 4) at or about 343° C. in Argon and at about 2040 atms, the resultant coating 48 produced conforms over the surface of the blade edge in that it effectively "hugs" the contours of the surface and creeps the polymer into the apertures 44*a* of FIG. 4 within the surface of the blade edge. Resultant coating 48 is depicted in the photograph of FIG. 4*c*.

The naked eye may easily note the differences in the coating surface morphology amongst the "before sintering" photograph (shown in FIG. 4*a*), the "after sintering" photograph (shown in FIG. 4*b*) and the "after HIP" photograph (shown in FIG. 4*c*). One visible difference includes the elimination in photographs of FIGS. 4*b* and 4*c* of the many agglomerations of PTFE particles 46*a* and the apertures (or pores) 44*a*. Particles 46*a* indicate areas of non-uniformity in the surface morphology of the coated blade edge in that by jutting out they may add thickness in those areas.

Figure 5A:
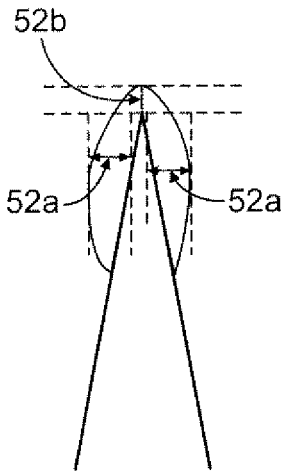
FIGS. 5*a*, 5*b* and 5*c* are schematics of different thickness profiles in accordance with the present invention.
Figure 5B:
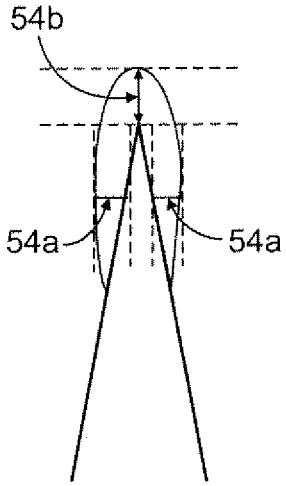
Figure 5C:
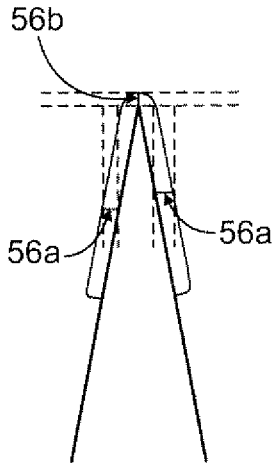
Figure 6:
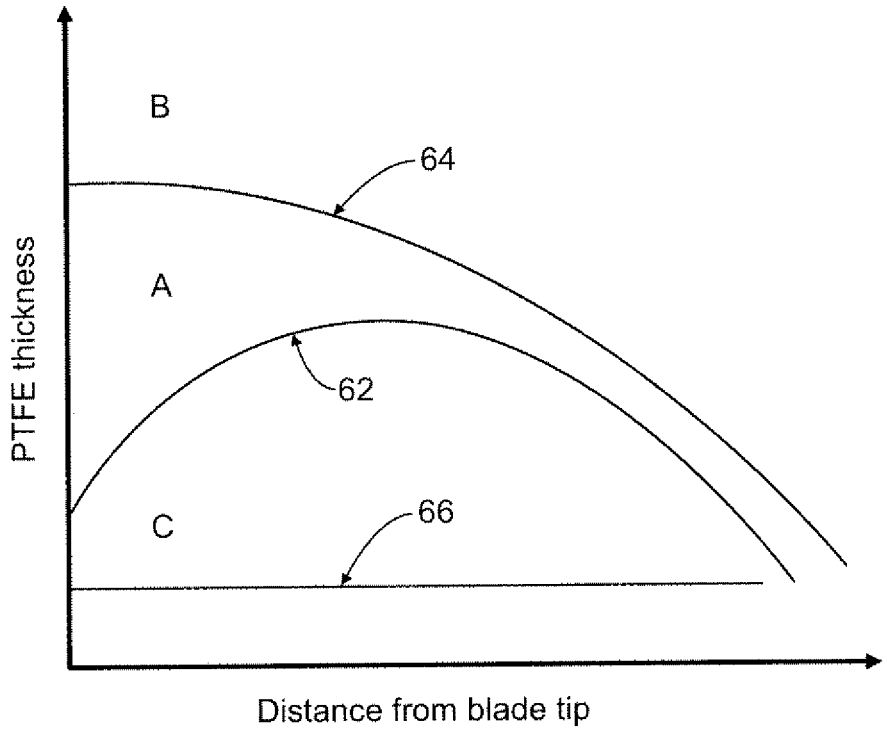
FIG. 6 is a graph of the thickness distributions of FIGS. 5*a*, 5*b*, and 5*c*.

Referring now to FIGS. 5*a*, 5*b*, and 5*c*, an illustration of non-uniform and uniform thickness profiles is shown and are all depicted in graph form in FIG. 6. Coating 52 is a non-uniform PTFE coating on a blade edge of the blade depicted in FIG. 5*a* where coating 52 is visually thicker on blade edges or sides depicted at 52*a* than at the blade tip shown at 52*b*. Coating 54 is a non-uniform PTFE coating on a blade edge of the blade depicted in FIG. 5*b* where coating 54 is visually thicker at the tip of the blade shown at 54*b* than on the sides 54*a* of the blade. In accordance with the present invention, coating 56 is shown to be of substantially uniform thickness at blade sides 56*a* and tip of the blade 56*b* of the blade depicted in FIG. 5*c*. In some instances, the thickness at the tip of the blade 56*b* may be slightly greater (not shown) than the thickness at the blades sides 56*a*. The range of dimensions for 52*a*, 52*b* and 54*a*, 54*b* are about 0.2 um to about 1 um and are reduced at 56*b* from about 20 nm to about 100 nm.

Coating thicknesses 52*a*, 52*b*, 54*a*, 54*b*, 56*a*, and 56*b* of blades depicted in FIGS. 5*a*, 5*b*, and 5*c*, vis-à-vis the distance from the blade tip, are also depicted in graph form in FIG. 6 where the x-axis represents the coating thickness values and the y-axis represents the distance from the blade tip values. As shown in FIG. 6, the blade of FIG. 5*c* with coating 56 has a uniform thickness (e.g., straight line 66 on the graph) regardless of the distance from the blade tip, whereas the blade of FIG. 5*b* with coating thicknesses 54*a* and 54*b* is depicted by a curve line 64 showing that the coating thickness is thickest at the tip but decreases the further it is away from the blade tip and whereas the blade of FIG. 5*a* with coating thicknesses 52*a* and 52*b* is depicted by a curve line 62 showing the coating as being thickest midway down the bevel edge of the blade and relatively thin at the blade tip.

It should be noted that HIP is less sensitive to what the pre-formed PTFE coating embodies in terms of thickness, uniformity, molecular weight, particle size, etc., and so it follows that, any method of initial PTFE coating may be utilized in accordance with the present invention, including, but not limited to, dipping, spin coating, sputtering, and thermal Chemical Vapor Deposition (CVD). Thus, no matter how non-uniform or poor an initially formed polymer coating is, the HIP process through the redistribution of PTFE material within the coating may produce a smoother, denser, more uniform coating with fuller coverage. Thus, advantageously it is contemplated that a simple dipping process could replace a spraying process for producing the initial polymer (e.g., PTFE) coating despite the former process having a less uniform outcome than the latter process.

It is further contemplated (not shown) that the present invention may include the prior art Flutec® technology of FIG. 1 with the isostatic processes (e.g., HIP process) herein described applied to the blade coating either before or after the Flutec® process.

Additionally, different dispersions or other forms of raw materials from various vendors may be readily used to achieve thin and uniform coatings.

Thus, the benefits obtained from the isostatic press approach on PTFE coated blades are achieved regardless of the method utilized for the initial PTFE coating on a blade edge and as such, is not limited to a particular coating type (e.g., a spraying process).

This indicates that the IP technology may generally be more robust in terms of blade edge quality and provide potentially beneficial cost savings.

The IP (HIP or CIP)-produced improved morphological features on the coating will minimize cutting force variations of the blade edge and better protect the blade from being damaged. Further, the IP processes will improve overall product quality and help consumers to achieve a smooth and consistent shave experience.

The present invention contemplates that the isostatic processes such as the HIP or CIP, or other related isostatic processes may also be applicable to being used with other fluoropolymers in addition to PTFE, including but not limited to PFA (perfluoroalkoxy polymer resin), FEP (fluorinated ethylene-propylene), ETFE (polyethylenetetrafluoroethylene), PVF (polyvinylfluoride), PVDF (polyvinyllidene fluoride), and ECTFE (polyethylenechlorotrifluoroethylene).

The present invention contemplates that the isostatic processes such as the HIP or CIP, or other related isostatic processes may also be applicable to being used with fluoropolymer (e.g., PTFE) composites, including, but not limited to PTFE/nanodiamond, PTFE/silica, PTFE/alumina, PTFE/silicone, PTFE/PEEK (polyetheretherketone), and PTFE/PFA.

Furthermore, the HIP process of the present invention is not necessarily constrained to being applied to PTFE or PTFE type materials and may also be applicable to other non-fluoropolymer (e.g., non-PTFE) coating materials, including, for instance, but not limited to, polyvinylpyrorridone (PVP), polyethylene, polypropylene, ultrahigh molecular weight polyethylene, polymethyl methacrylate, parylene and/or others.

Additionally, the razor blade substrate may be comprised of steel with or without top layer coatings such as Chromium (Cr), Diamond-like Carbon (DLC), Amorphous Diamond, Chromium/Platinum (Cr/Pt) or other suitable materials or combination of materials. It has been shown that the blade substrate being comprised of these materials (e.g., Cr or DLC) improves adhesion of the polymer coating material on the blade edge after HIP conditions have been applied.

In another embodiment of the present invention it is contemplated that the HIP conditions may be used in conjunction with a dry shaver in addition to a wet shaver where the cutter blades of the dry shaver are similarly subjected to HIP conditions as described above.

It is further contemplated in yet another embodiment of the present invention that the HIP conditions described above may be used in conjunction with blades that are implemented in medical or surgical instruments, such as surgical blades, scalpels, knives, forceps, scissors, shears, or the like or other non-surgical blades or cutting instruments.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for forming a razor blade comprising:

isostatically pressing (IP) at least one blade edge coated with at least one polymeric material, wherein said isostatically-pressed polymer coating ranges in thickness from about 10 nm to about 100 nm and wherein said razor blade is comprised of steel, Chromium (Cr), Diamond-like Carbon (DLC), Amorphous Diamond, or Chromium/Platinum (Cr/Pt).

2. The method of claim 1 wherein said isostatic pressing is comprised of a hot isostatic press (HIP) or a cold isostatic press (CIP).

3. The method of claim 2 wherein said HIP further comprises a temperature in the range of about 300° C. to about 380° C.

4. The method of claim 2 wherein said HIP further comprises a pressure range of about 10 MPa to about 550 MPa.

5. The method of claim 2 wherein said HIP further comprises an inert atmosphere of argon or nitrogen.

6. The method of claim 2 wherein said HIP is applied for a time ranging from about 10 minutes to about 10 hours.

7. The method of claim 1 wherein said polymeric material comprises a fluoropolymer.

8. The method of claim 1 wherein said isostatically-pressed polymer coating has a substantially uniform surface morphology.

9. The method of claim 1 wherein said isostatically-pressed polymer coating has substantially zero porosity.

10. The method of claim 1 wherein said step of isostatically pressing is applied to said polymeric material after said polymeric material has been sintered.

11. The method of claim 1 wherein said polymeric material comprises a non-fluoropolymer.

12. The method of claim 1 wherein said at least one blade edge is coated with said polymer by dipping, spin coating, sputtering, or thermal Chemical Vapor Deposition (CVD).

* * * * *